United States Patent [19]

Jahnke

[11] Patent Number: 4,680,565

[45] Date of Patent: Jul. 14, 1987

[54] MAGNETIC FIELD DEVICE FOR A SYSTEM FOR THE ACCELERATION AND/OR STORAGE OF ELECTRICALLY CHARGED PARTICLES

[75] Inventor: Andreas Jahnke, Forchheim, Fed. Rep. of Germany

[73] Assignee: Siemens Aktiengesellschaft, Berlin and Munich, Fed. Rep. of Germany

[21] Appl. No.: 874,495

[22] Filed: Jun. 16, 1986

[30] Foreign Application Priority Data

Jun. 24, 1985 [DE] Fed. Rep. of Germany ..... 3522528

[51] Int. Cl.[4] ..... H01F 7/22

[52] U.S. Cl. ..... 335/216; 335/299; 328/235

[58] Field of Search ..... 335/210, 213, 216, 299; 328/235

[56] References Cited

U.S. PATENT DOCUMENTS 3,283,276 11/1966 Hritzay ..... 335/299 X
4,623,847 11/1986 Anderberg et al. ..... 328/235

FOREIGN PATENT DOCUMENTS 3148100 6/1983 Fed. Rep. of Germany .
3504223 7/1984 Fed. Rep. of Germany .
3504211 7/1986 Fed. Rep. of Germany .

OTHER PUBLICATIONS

Technical Report of ISSP, Sep. 1984, Ser. B, No. 21, pp. 1–29.
Nuclear Instruments and Methods 177 (1980), pp. 411–416.
R. Kollath, "Particle Accelerators", Braunschweig 1955, p. 23.
Nuclear Instruments & Methods in Physics Research, vol. 204 (1982) Dec., pp. 1–20.
IEEE Trans. on Nuclear Science, vol. NS-30 (1983) Aug., No. 4, pp. 2042–2044.

*Primary Examiner*—George Harris
*Attorney, Agent, or Firm*—Kenyon & Kenyon

[57] ABSTRACT

A magnetic field device for a system for acceleration and/or storage of electrically charged particles, particularly electrons, comprises curved sections in the particle trajectory, in which an accordingly curved dipole magnet is arranged, which contains superconducting windings and a supplemental winding and with which a magnetic guidance field for the particle beam can be generated which has a weakly focusing effect due to corresponding field gradients. It should be possible to bring about these field gradients in a relatively simple manner also for a high magnetic flux density. Accordingly, it is provided for this purpose that with each dipole magnet which is at least free of iron, a superconducting supplemental winding is associated which is curved accordingly, adjoins at least with its convex outside the region of the concave inside of the curved dipole windings, and with which the necessary field gradients can be brought about in substance.

8 Claims, 2 Drawing Figures

MAGNETIC FIELD DEVICE FOR A SYSTEM FOR THE ACCELERATION AND/OR STORAGE OF ELECTRICALLY CHARGED PARTICLES

BACKGROUND OF THE INVENTION

The present invention relates to a magnetic field device for a system for the acceleration and/or storage of electrically charged particles, especially of electrons, the particle trajectory of which has curved sections, in which respectively curved dipole magnets are arranged which contain superconducting windings and a supplemental winding and by which a magnetic guidance field for the particle beam can be generated which has a weakly-focusing action due to corresponding field gradients. Such a device is known, for instance, from the publication "Superconducting Racetrack Electron Storage Ring and Coexistent Injector Microtron for Synchrotron Radiation" of the "Institute for Solid State Physics" of the University of Tokyo, Japan, September 1984, Ser. B, No. 21, pages 1 to 29.

With known smaller circular electron accelerators, also called "Microtrons," particle energies up to about 100 MeV can be obtained. These systems can be realized also as so called racetrack microtrons. The particle trajectories of this type of accelerator are composed of two semi-circles, each with an appropriate 180° deflection magnet and of two straight track sections (see also "Nucl. Instr. and Meth.," vol. 177, 1980, pages 411 to 416, or vol. 204, pages 1 to 20).

If the desired final energy of the electrons is to be increased from about 100 MeV to 1 GeV, one suggestion is to increase the magnetic field while leaving the dimensions alone. Such magnetic fields can be produced in particular by superconducting magnets.

Also the electron storage ring system from the publication first cited above has in its curved sections dipole magnets with superconducting windings. It is generally assumed there that the guiding field for the particle beam generated in the vicinity of these magnets has a weakly focusing action due to appropriate field gradients. A measure of this type of focusing is the so-called field index n, which is generally defined as:

$$n = \frac{-r_o}{B_{zO}} \cdot \frac{\partial B}{\partial r}$$

where $r_o$ is the radius of the particle trajectory, $B_{zO}$ the component of the magnetic induction perpendicular relative to the particle trajectory, and $\partial B/\partial r$ is the field gradient (see, for instance, R. Kollath: "Particle Accelerators," Braunschweig, 1955, page 23). In case of weak focusing, the field index is between about 0.3 and 0.7 and particularly approximately 0.5.

Such a weak focusing in the curved trajectory sections is generally achieved in known storage ring systems by special shapes of the pole pieces of an iron yoke of the dipole magnet surrounding the particle trajectory as well as, optionally, by special supplemental windings. Also in the storage ring system from the publication first cited above, the superconducting dipole magnets have iron yokes. These yokes are pierced outwards in the equatorial plane of the particle track in order to provide an outlet for and thereby, the utilization of the synchrotron radiation which occurs in the curved sections of the particle track.

Apart from the fact that in the known storage ring system, the formation of an appropriate iron yoke is comparatively expensive, also the contribution of the iron yoke to the magnetic flux density is limited upwards due to the magnetic saturation of the material.

SUMMARY OF THE INVENTION

It is therefore an object of the present invention to improve the known magnetic field device such that the field gradients required for weak focusing of the particle beam can be realized in the region of their curved dipole coils in a relatively simple manner and the equipment required therefor is limited without limitation of the magnitude of the magnetic induction due to the saturation magnetization of iron.

The above and other objects of the invention are achieved by assigning to each at least largely iron-free dipole magnet a superconducting supplemental winding which is curved accordingly, is adjacent with its convex outside to the region of the concave inside of the curved dipole windings, and by which the required field gradients can essentially be brought about.

The supplemental winding of each dipole magnet thus has a curved shape which corresponds to that of the dipole windings. The advantages connected therewith are, in particular, that the same methods for manufacturing the supplemental winding can be used as for the superconducting dipole windings. Such methods are proposed, for instance, by German Patent Application Nos. P 34 44 983.3, P 35 04 211.7 or P 35 04 223.0.

In addition, the volume occupied by a curved supplemental winding and filled by the magnetic field is relatively small, so that the energy which can be stored in it is advantageously correspondingly small. In addition, enough space is left in the interior of the curved supplemental coil in the region of its radius center to arrange mechanical support structures for the dipole windings and the supplemental windings.

BRIEF DESCRIPTION OF THE DRAWINGS

For a further explanation of the invention, reference is made to the drawings, in which.

DETAILED DESCRIPTION

Figure 1:
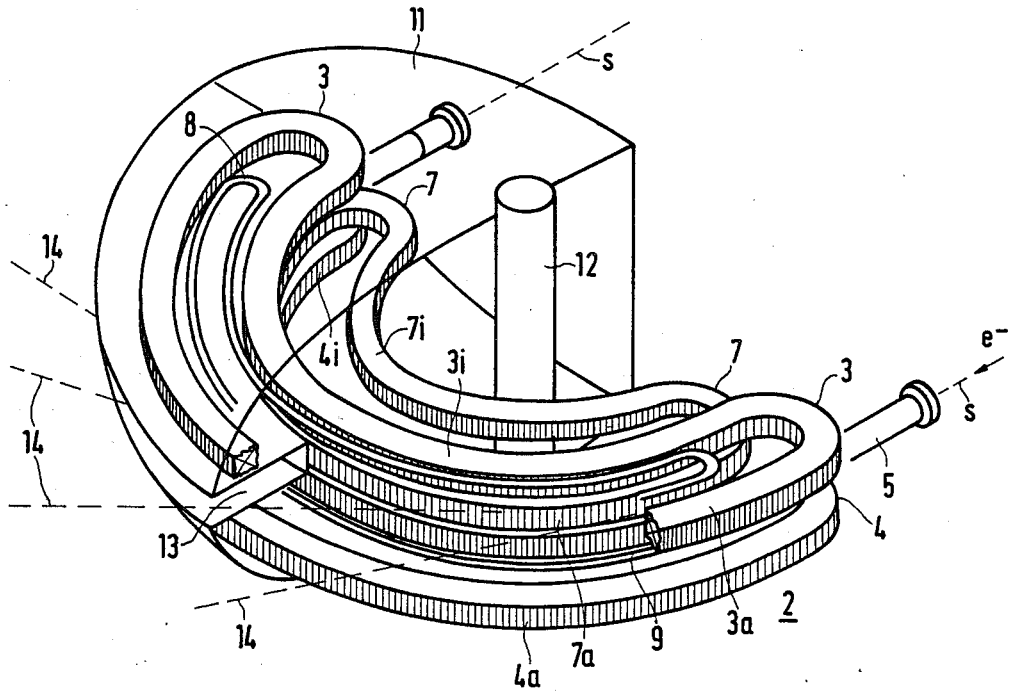
FIG. 1 shows a magnetic field device according to the invention which is part of an electron accelerator or an electron storage ring system.
Figure 2:
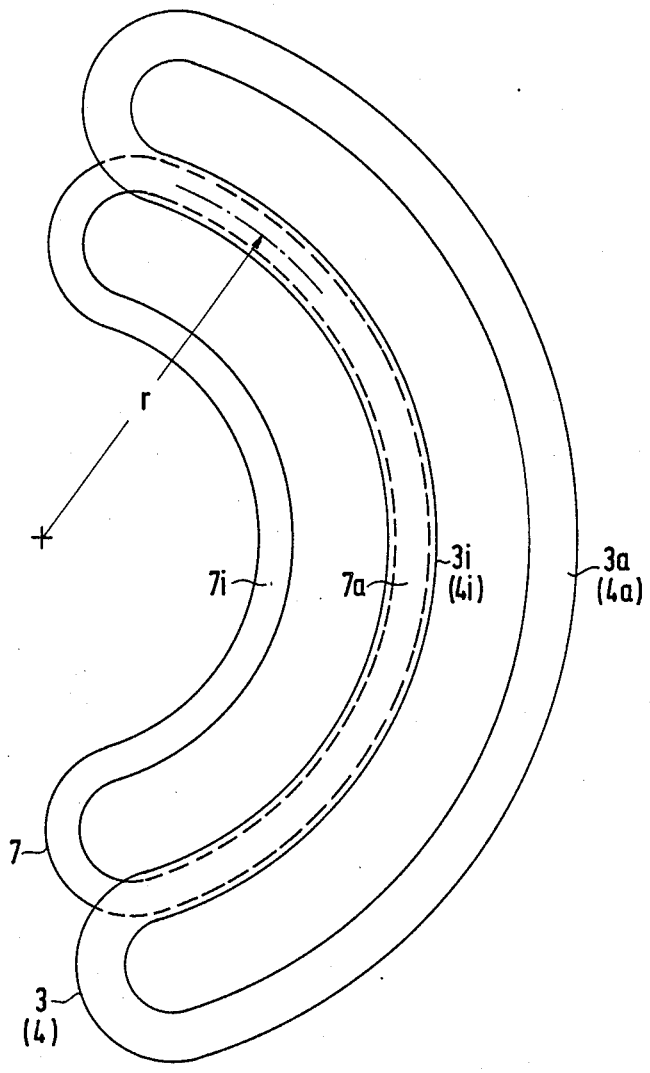
FIG. 2 shows schematically the superconducting windings of such a magnetic field device. Parts agreeing in the figures are provided with the same reference symbols.

In FIG. 1, a curved dipole deflection magnet of an electron accelerator or a storage ring system with a partially broken-away presentation is shown schematically in an oblique view. The dipole magnet, designated in general with 2, is likewise curved due to the curved particle trajectory s and can be bent, in particular, in the shape of a semicircle (see, for instance, the publication first cited above). Since in particular, final energies of the electrons $e^-$ of several 100 MeV are desired, the windings 3 and 4 of the magnet are preferably made of superconductive material because of the high field intensities required therefor. These dipole windings 3 and 4, which are also called main windings, are arranged on both sides of an electron beam tube 5 extending along the particle trajectory s lying in parallel planes, and, due to their curvature, always have a concave inside 3*i* and 4*i*, respectively, and a convex outside 3*a* and 4*a*, respectively. In the equatorial plane subtended by the beam tube 5 and the particle trajectory s, there is also arranged, according to the invention, a superconducting supplemental winding 7 by which the field gradients required for weak focusing with a field index n between about 0.3 and 0.7 and in particular of about 0.5, of the dipole field produced by the main windings 3 and 4 can be brought about, at least substantially. The supplemental winding 7 which can therefore also be called a gradient winding has a curved shape corresponding to the shape of the main windings 3 and 4. This supplemental winding 7 at least adjoins with its outside 7*a* the region determined by the insides 3*i* and 4*i* of the main windings 3 and 4. As can be seen in detail from the schematic top view of FIG. 2, the concave insides 3*i* and 4*i* of the dipole windings 3 and 4 and the convex outside 7*a* of the supplemental winding 7 can also overlap, i.e., these windings then have approximately the same radius of curvature r in this region.

It is furthermore indicated in FIG. 1 that in the area surrounded by the superconducting main windings 3 and 4, an appropriately curved superconducting secondary winding 8 and 9, respectively, can be provided. Since the conductors of the windings 3, 4, 7 and 9 consist of superconductive material, a common cryostat or helium housing 11 is provided for these windings. The housing 11 and thereby, the windings contained therein can be fastened to a tower-like mounting support 12 or to another support device which can advantageously be arranged, due to the curved shape of the supplemental winding 7, approximately in the center of the radii of curvature of the winding and thus outside the areas respectively enclosed by the windings 3, 4, 7. Thereby, also problems with eddy currents in the mounting support 12 can be reduced substantially. In addition, the housing 11 is made in the area of the equatorial plane from the outside of the dipole magnet 2 not continuous but quasi of two parts for reasons of bringing out undisturbed the synchrotron radiation occurring in the curved part of the particle trajectory s. Thereby, a slot-like radiation chamber 13 is formed which extends between the convex outsides 3*a* and 4*a* of the main winding all the way to the outside 7*a* of the superconducting supplemental winding 7. The synchrotron radiation leaving this radiation chamber tangentially is indicated in the figure by dashed lines 14.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A magnetic-field device for a system for at least one of the acceleration and storage of electrically charged particles, particularly electrons, the particle trajectory of which has curved sections, and having an appropriately curved dipole magnet having a concave section and a convex section, the dipole magnet comprising superconducting windings for generating a magnetic guiding field for the particle beam which has a weakly focusing effect due to field gradients thereof, each dipole magnet being at least largely free of iron and having associated therewith a superconducting supplemental winding, said superconducting supplemental winding being curved to match said superconducting windings of said dipole magnet, and having a convex section which adjoins a region of the concave sections of the curved windings of the dipole magnet, whereby the required field gradients can substantially be generated.

2. The magnetic-field device recited in claim 1, wherein the supplemental winding is arranged in an intermediate plane extending between parallel planes of the superconducting windings of the dipole magnet.

3. The magnetic-field device recited in claim 1, wherein the convex section of the supplemental winding as well as the concave sections of the superconducting windings of the dipole magnet overlap at least partially.

4. The magnetic-field device recited in claim 1, wherein the supplemental winding and the windings of the dipole magnet are disposed in a common cryostat housing.

5. The magnetic-field device recited in claim 4, wherein the supplemental winding and the superconducting windings of the dipole magnet are fastened to a central support means via the cryostat housing.

6. The magnetic-field device recited in claim 5, wherein the support means is arranged on the inside of the dipole magnet and outside the areas defined by the dipole magnet and supplemental windings.

7. The magnetic-field device recited in claim 4, wherein the cryostat housing comprises a slot-like radiation chamber in the region of the center plane fixed by the particle trajectory on its outside for allowing synchrotron radiation to be emitted.

8. The magnetic-field device recited in claim 1, wherein, in the areas enclosed by each of the dipole magnet windings, a secondary dipole winding with superconducting conductors is arranged.

* * * * *